US009833056B1

(12) United States Patent
Brown

(10) Patent No.: US 9,833,056 B1
(45) Date of Patent: Dec. 5, 2017

(54) SHOULDER SLING RETAINER

(71) Applicant: Erwin A. Brown, Russell, MA (US)

(72) Inventor: Erwin A. Brown, Russell, MA (US)

( * ) Notice: Subject to any disclaimer, the term of this patent is extended or adjusted under 35 U.S.C. 154(b) by 0 days.

(21) Appl. No.: 15/391,898

(22) Filed: Dec. 28, 2016

Related U.S. Application Data

(60) Provisional application No. 62/272,825, filed on Dec. 30, 2015.

(51) Int. Cl.
*A45F 3/14* (2006.01)

(52) U.S. Cl.
CPC ..... *A45F 3/14* (2013.01); *A45F 2003/142* (2013.01)

(58) Field of Classification Search
CPC ..... A45F 3/14; A45F 2003/142; A45F 3/12; A41D 27/26; A41F 15/007
See application file for complete search history.

(56) References Cited

U.S. PATENT DOCUMENTS

| | | | | |
|---|---|---|---|---|
| 978,620 | A * | 12/1910 | Murk | A41F 15/007 2/268 |
| 2,487,423 | A * | 11/1949 | Cast | A41D 27/26 2/460 |
| 2,748,390 | A | 6/1956 | Carlson | |
| 2,792,607 | A | 5/1957 | Packham | |
| 2,932,869 | A | 4/1960 | Neubig | |
| 3,052,886 | A | 9/1962 | White | |
| 3,083,885 | A | 4/1963 | Ware | |
| 3,153,791 | A | 10/1964 | White | |
| 3,940,039 | A | 2/1976 | Sasaki | |
| 3,956,805 | A | 5/1976 | Stroh | |
| 3,982,305 | A | 9/1976 | Meyer | |
| 3,988,809 | A | 11/1976 | Powell et al. | |
| 4,040,147 | A | 8/1977 | King | |
| 4,386,723 | A | 6/1983 | Mule | |
| 4,811,876 | A | 3/1989 | Riggi | |
| 5,441,188 | A | 8/1995 | Rosenstein | |
| 7,434,301 | B1 | 10/2008 | Johnson | |

(Continued)

FOREIGN PATENT DOCUMENTS

| | | |
|---|---|---|
| FR | 2665339 | 8/1990 |

OTHER PUBLICATIONS

"Cardinal Black Shoulder Holder Clip," Songbird Garden, songbirdgarden.com, SKU# AESHGB711. http://www.songbirdgarden.com/store/scripts/prodView.asp?idproduct=11208, Apr. 12, 2015.

(Continued)

*Primary Examiner* — Corey Skurdal
(74) *Attorney, Agent, or Firm* — Doherty, Wallace, Pillsbury & Murphy, P.C.

(57) ABSTRACT

A shoulder sling retainer comprising a substantially planar exterior directed wall flanked on one end thereof by an abutment wall which extends substantially perpendicularly therefrom. The retainer is configured such that the shoulder sling rests atop the exterior directed wall, and is prevented from sliding off of the exterior directed wall via the abutment wall. A bottom side of the retainer, which is oppositely situated from the exterior directed wall, is configured to rest securely on a shoulder portion of a garment, and, to that end, has a generally concave configuration. An engagement member that secures the retainer to a shoulder portion of the garment may be integrally formed with the bottom side of the receiver.

10 Claims, 6 Drawing Sheets

(56) References Cited

U.S. PATENT DOCUMENTS

| | | | |
|---|---|---|---|
| D607,210 | S | 1/2010 | Reynolds |
| 7,725,958 | B1 | 6/2010 | Gilmore |
| 8,006,353 | B2 | 8/2011 | Reynolds |
| 2006/0289575 | A1 | 12/2006 | Chou |
| 2013/0068807 | A1 | 3/2013 | Elam |

OTHER PUBLICATIONS

"Purse Strap Holder: Home," http://pursestrapholder.com/, Apr. 12, 2015.

"Ortho Tote Non-Slip Shoulder Strap Pad, Black," Amazon, Seller: OrthoTote. http://www.amazon.com/Ortho-Non-Slip-Shoulder-Strap-Black/dp/B000A7V3HW, Apr. 12, 2015.

* cited by examiner

SHOULDER SLING RETAINER

BACKGROUND OF THE INVENTION

1. Field of the Invention

The present invention relates to a retainer for a shoulder sling or a strap, and more particularly, to a retainer which is worn on a shoulder region of a user's garment, wherein the retainer secures a shoulder sling or strap to the shoulder region.

2. Background of the Invention

When a shoulder sling, which may be used to hold an object, such as, e.g., a firearm, a fishing rod bag, a camera case, a shoulder bag, and the like, is hung over a shoulder portion of a garment, the shoulder sling frequently slips off of the garment shoulder portion. Every time that the shoulder sling slips off of the garment shoulder portion, it is necessary to put the shoulder sling back in its proper position on the shoulder portion of the garment. This requires time-consuming and tedious hand work, especially when the user who wears the shoulder sling on a shoulder portion of his garment carries articles in both of his hands. Every time that the shoulder sling slips off of the shoulder portion of the garment, in order to put the shoulder sling back into place on the garment shoulder portion, the user must unload the articles from one hand or both hands. Thus, it is quite inconvenient and annoying to put the shoulder sling back into place on the garment shoulder portion.

Therefore, what is needed is a shoulder sling retainer that can securely hold a shoulder sling, wherein the retainer easily attaches to a shoulder portion of a garment, and further wherein the retainer has sufficient and effective holding ability, is operable in a simple manner, and which easily can be attached and detached from the garment shoulder portion.

BRIEF SUMMARY OF THE INVENTION

One object of the present invention is to provide a novel and improved retainer for a shoulder sling which effectively eliminates the problems in connection with the slipping of the shoulder sling off of a shoulder portion of a garment when the shoulder sling is carried about by a user over the garment shoulder portion.

According to the present invention, there has been provided a single molded retainer attachable to the outer garment of a person engaging in a variety of activities, including, e.g., hunting, fishing, and the like that require carrying an object with a strap or sling.

In an exemplary embodiment, the shoulder sling retainer comprises a substantially planar exterior directed wall flanked on one end thereof by an abutment wall which extends substantially perpendicularly therefrom. The retainer is configured such that the shoulder sling rests atop the exterior directed wall and is prevented from sliding off of the exterior directed wall via the abutment wall. A bottom side of the retainer, which is oppositely situated from the exterior directed wall, is configured to rest securely on a shoulder portion of a garment, and, to that end, has a generally concave configuration. An engagement member that secures the retainer to a shoulder portion of the garment may be integrally formed with the bottom side of the receiver, and provides a means by which the retainer may be easily applied or removed from the shoulder portion of the garment.

The advantages to the shoulder sling retainer are many and include the fact that the retainer allows a hunter, fisherman or outdoor person to use both hands so that one hand is not needed to keep the sling on the shoulder. When it is cold the person can utilize pockets to keep their hands warm. Additionally, the retainer is light and small.

The above and other objects and attendant advantages of the present invention will be more readily apparent to those skilled in the art from a reading of the following detailed description in conjunction with the accompanying drawing which shows one preferred embodiment of the invention for illustration purpose only, but not for limiting the scope of the same in any way.

DETAILED DESCRIPTION OF THE INVENTION

Figure 1:
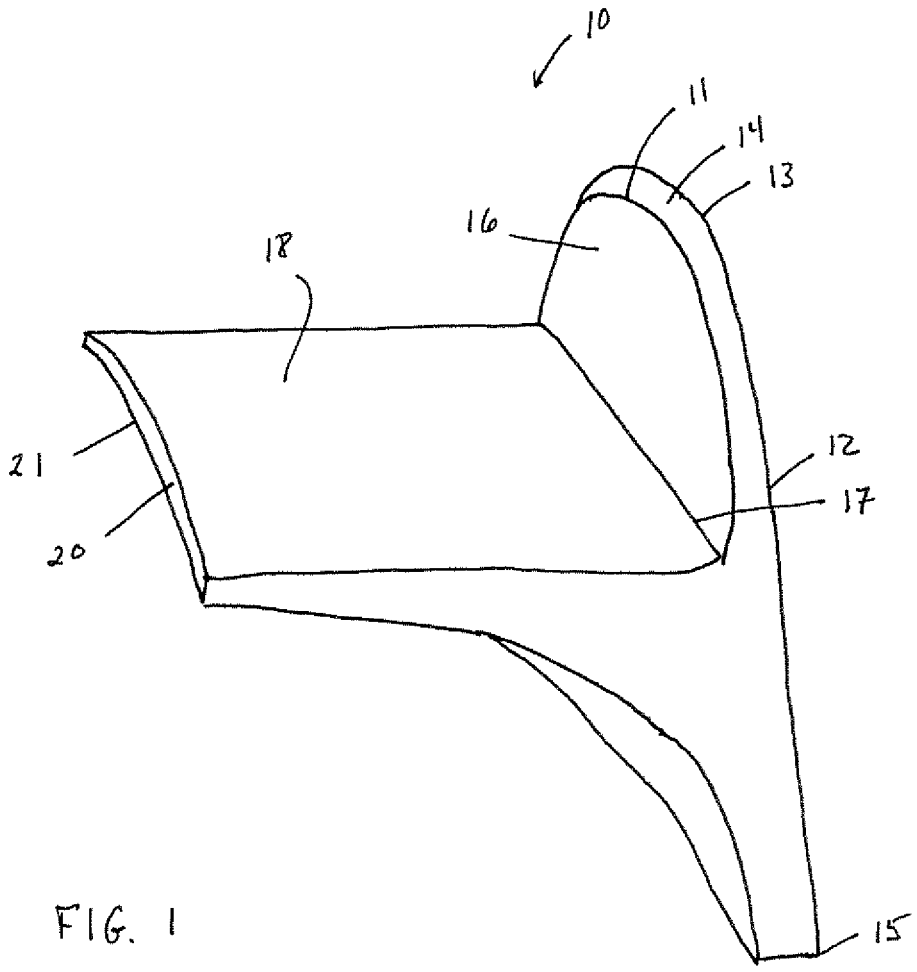
FIG. 1 is a schematic depicting a side elevational view of a top side of an exemplary retainer.
Figure 2:
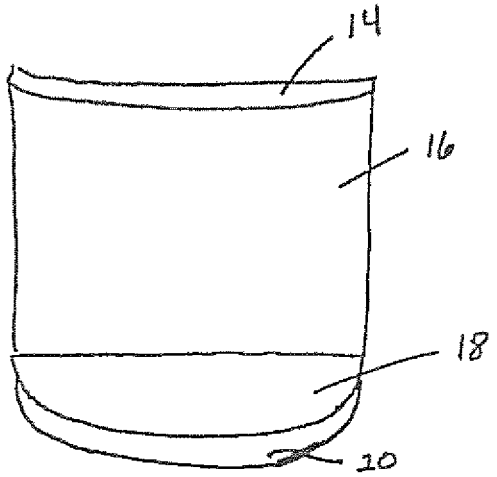
FIG. 2 is a schematic depicting a planar view of the upper wall, the abutment wall, the top wall, the rearward facing wall of the retainer depicted in FIG. 1.
Figure 3:
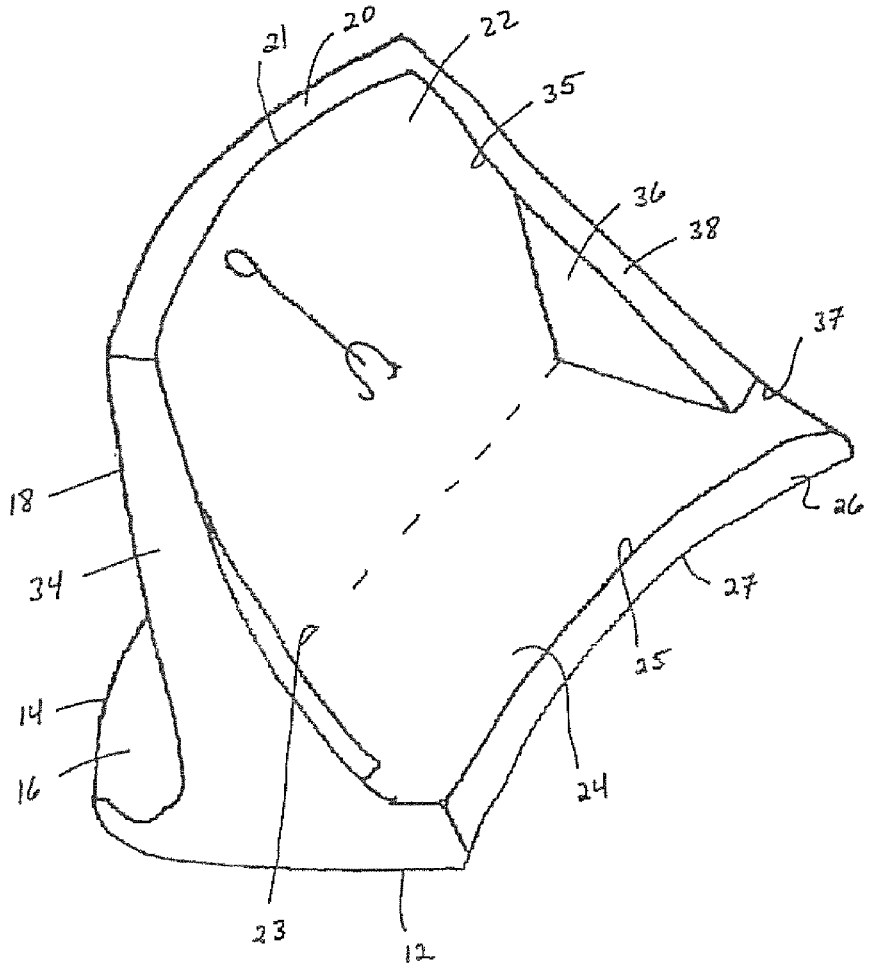
FIG. 3 is a schematic depicting an elevational view of a distal side of a bottom side of the retainer depicted in FIG. 1.
Figure 4:
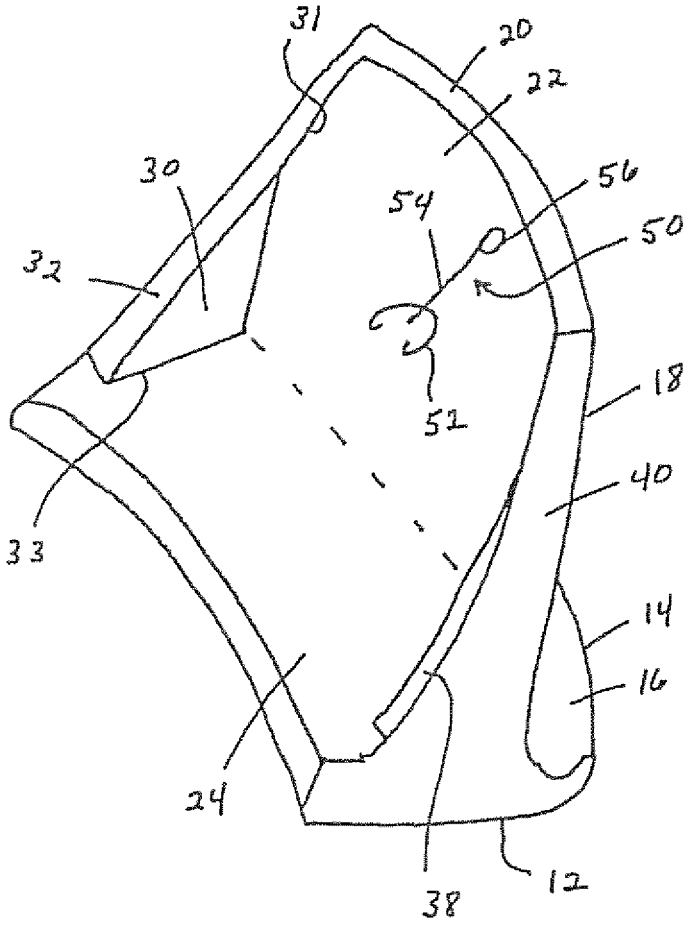
FIG. 4 is a schematic depicting an elevational view of a proximal side of the bottom side of the retainer depicted in FIG. 1.
Figure 5:
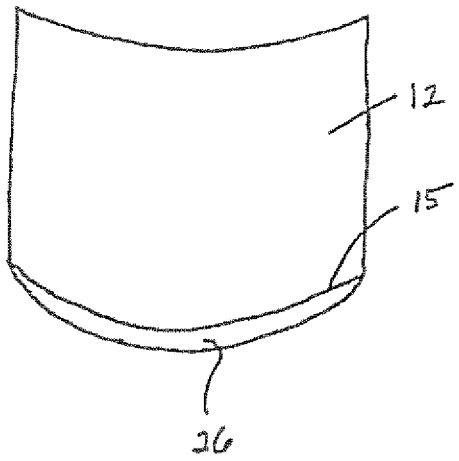
FIG. 5 is a schematic depicting a planar view of the forward facing wall and the lower wall of the retainer depicted in FIG. 1.

The present invention will be now described referring to the accompanying drawings and which show a preferred embodiment of the retainer for a shoulder sling constructed in accordance with the present invention. In these Figures, a retainer 10 comprises a forward facing wall 12. At an upper edge 13 thereof, forward facing wall 12 turns to form a generally concave shaped upper wall 14. At an anterior edge 11 thereof, upper wall 14 turns to form an abutment wall 16 which is substantially parallel with forward facing wall 14. At a lower edge 17 thereof, abutment wall 16 turns in a direction opposite to forward facing wall 12 to form an exterior directed wall 18. At an anterior edge 19 thereof, exterior directed wall 18 turns in a direction opposite to abutment wall 16 to form a generally concave shaped rearward facing wall 20. At a lower edge 21 thereof, generally concave shaped rearward facing wall 20 turns towards abutment wall 16 to form an upper interior wall 22 which is oppositely formed with exterior directed wall 18. At a posterior edge 23 thereof, upper interior wall 22 slopes to form a generally concave shaped lower interior wall 24 which is oppositely formed with forward facing wall 12. At a lower edge 25 thereof, concave shaped lower interior wall 24 turns in a direction opposite to rearward facing wall 20 to form a substantially concave shaped lower wall 26. A posterior edge 27 of lower wall 26 is contiguously formed with a lower edge 15 of forward facing wall 12.

A proximal flange 30 is integrally formed with proximal edges 31 and 33 of respective upper interior wall 22 and generally concave shaped lower interior wall 24. Proximal flange 30 turns to form a generally concave-shaped proximal shoulder 32 that is contiguously formed with rearward facing wall 20. Proximal shoulder 32 turns towards forward facing wall 12 to form a proximal side wall 34 that is contiguously formed with upper wall 14, abutment wall 16, exterior directed wall 18, rearward facing wall 20, lower wall 26, and forward facing wall 12.

A distal flange 36 is integrally formed with distal edges 35 and 37 of respective upper interior wall 22 and generally concave shaped lower interior wall 24. Distal flange 36 turns to form a generally concave-shaped distal shoulder 38 that is contiguously formed with rearward facing wall 20. Distal shoulder 38 turns towards forward facing wall 12 to form a distal side wall 40 that is contiguously formed with upper wall 14, abutment wall 16, exterior directed wall 18, rearward facing wall 20, lower wall 26, and forward facing wall 12.

Retainer 10 further comprises an attachment member 50. Attachment member 50 comprises a longitudinally extending body (not shown) embedded between exterior directed wall 18 and upper interior wall 22. Attachment member 50 further comprises a catch plate 52 contiguously formed with the longitudinally extending body and which is positioned such that upper interior wall 22 is sandwiched between catch plate 52 and the longitudinally extending body (not shown). Attachment member 50 further comprises a coiled element 56 contiguously formed with the longitudinally extending body and which extends from upper interior wall 22 and is in general alignment with catch plate 52. A pin element 54 is continuously formed with and extends from coiled element 52 and is engaged with catch plate 52 to secure pin element 54 to catch plate 52.

Figure 6:
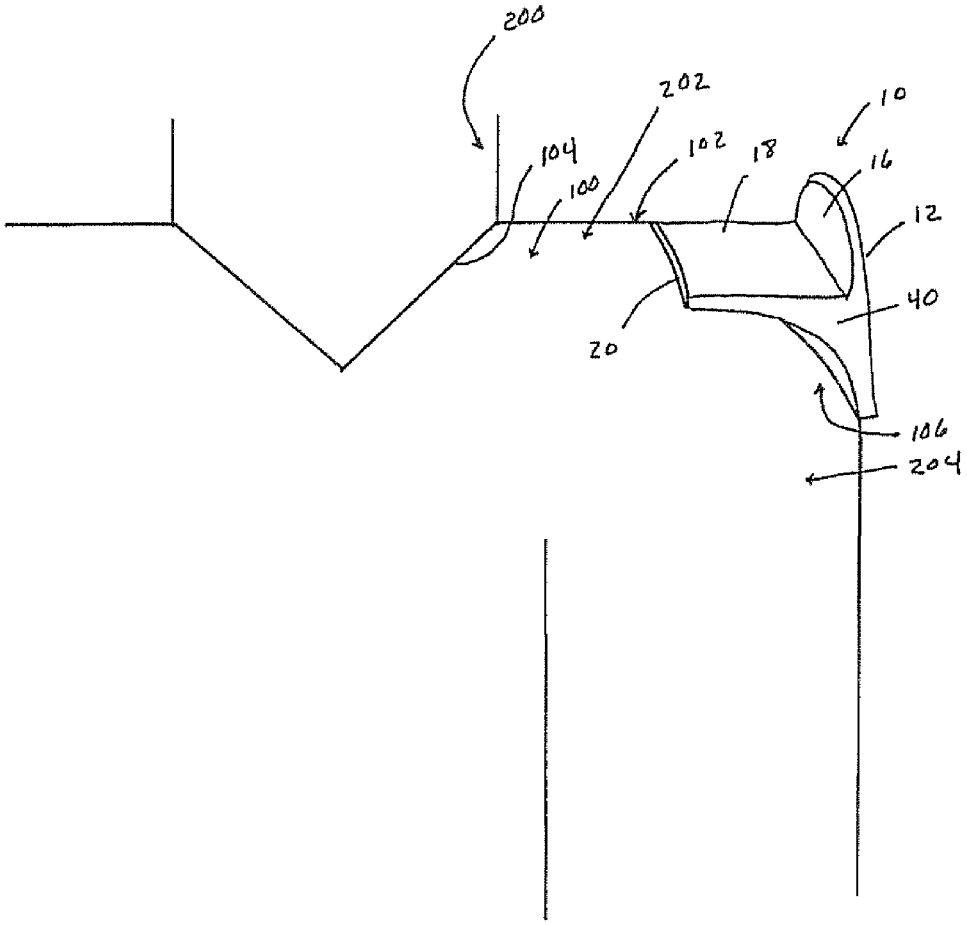
FIG. 6 is a schematic depicting the retainer depicted in FIG. 1 worn by a user and positioned on the user's shirt.

Referring to FIG. 6, retainer 10 may be applied to a shirt 100 by directing rearward facing wall 20 towards a neck portion 104 of shirt 100 such that forward facing wall 12 is directed away from neck portion 104, directing upper interior wall 22 towards a shoulder portion 102 of shirt 100, and directing lower interior wall 24 towards an upper arm portion 106 of shirt 100. Retainer 10 may then be attached to shirt 100 via attachment member 50. Once so positioned, retainer 10 rests comfortably and securely atop a shoulder 202 and an upper arm 204 of a user. A shoulder sling may then be positioned over a neck 200 and shoulder 202 of the user such that the shoulder sling overlaps proximal and distal side walls 34 and 40 and such that a bottom side of the shoulder sling lies on exterior directed wall 18. Abutment wall 16 acts as a buttress to prevent the shoulder sling from falling from disengaging from retainer 10.

As is clear from the foregoing description of the preferred embodiment of the invention, the retainer of the invention exhibits its excellent practical effects when the retainer is employed in conjunction with a shoulder sling when the shoulder sling is carried about by a user.

While only one embodiment of the invention has been shown and described in detail, it will be understood that the same is for illustration purpose only and not to be taken as a definition of the invention, reference being had for the purpose to the appended claims.

What is claimed is:

1. A retainer for a shoulder sling, wherein the retainer comprises:

a forward facing wall, which turns at an upper edge thereof to form an upper wall, wherein an anterior edge of the upper wall turns to form an abutment wall which is substantially parallel with the forward facing wall, and wherein a lower edge of the abutment wall turns in a direction opposite to the forward facing wall to form an exterior directed wall which is recessed relative to the upper edge, wherein at an anterior edge of the exterior directed wall, which is directed opposite to the abutment wall, the exterior directed wall turns in a direction opposite to the abutment wall to form a rearward facing wall, wherein at a lower edge thereof the rearward facing wall turns towards the abutment wall to form an upper interior wall which is oppositely formed with the exterior directed wall, wherein at a posterior edge of the upper interior wall, the upper interior wall slopes to form a lower interior wall which is oppositely formed with the forward facing wall, wherein the lower interior wall turns at a lower edge thereof in a direction opposite to the rearward facing wall to form a lower wall, wherein a posterior edge of the lower wall is contiguously formed with a lower edge of the forward facing wall;

a proximal flange and a distal flange, wherein the proximal flange is oppositely situated to the distal flange, and further wherein each of the proximal flange and the distal flange are integrally formed with the upper interior wall and the lower interior wall; and a proximal side wall and a distal side wall, wherein the proximal side wall is oppositely situated to the distal side wall, and further wherein each of the proximal side wall and the distal side wall are contiguously formed with the upper wall, the abutment wall, the exterior directed wall, the rearward facing wall, the lower wall, and the forward facing wall.

2. The retainer of claim 1, further comprising an attachment member disposed on the upper interior wall.

3. The retainer of claim 2, wherein the attachment member is further disposed on the lower interior wall.

4. The retainer of claim 1, wherein the lower interior wall has a generally concave configuration.

5. The retainer of claim 1, wherein the forward facing wall comprises a generally tombstone configuration.

6. The retainer of claim 5, wherein the abutment wall extends up to about half the length of the forward facing wall.

7. A method for securing a shoulder strap to a user, the method comprising:

providing a retainer as provided for in claim 1;

providing a garment having a neck portion, a shoulder portion, and an upper arm portion;

directing the lower edge of the retainer towards the neck portion;

resting the upper interior wall on the shoulder portion of the garment; and resting the lower interior wall on the upper arm portion of the garment.

8. The method of claim 7, further comprising providing a shoulder strap, and resting a portion of the strap on the exterior directed wall of the retainer.

9. The method of claim 8, wherein the retainer further comprises an attachment member, and wherein the method further comprises engaging the attachment member with the garment.

10. The method of claim 9, wherein the attachment member comprises a pin and a catch plate, wherein engaging the attachment member with the garment comprises having the catch plate receive and hold the pin.

* * * * *